United States Patent [19]

Campbell et al.

[11] 4,157,904

[45] Jun. 12, 1979

[54] HYDROCARBON GAS PROCESSING

[75] Inventors: Roy E. Campbell; John D. Wilkinson, both of Midland, Tex.

[73] Assignee: The Ortloff Corporation, Midland, Tex.

[21] Appl. No.: 843,321

[22] Filed: Oct. 18, 1977

Related U.S. Application Data

[63] Continuation-in-part of Ser. No. 728,963, Oct. 4, 1976, abandoned, which is a continuation-in-part of Ser. No. 712,771, Aug. 9, 1976, abandoned.

[51] Int. Cl.[2] ..... F25J 3/02

[52] U.S. Cl. ..... 62/27; 62/23; 62/38

[58] Field of Search ..... 62/23, 24, 27, 28, 38, 62/39

[56] References Cited

U.S. PATENT DOCUMENTS

| | | | |
|---|---|---|---|
| Re. 25,193 | 7/1962 | Schilling et al. | 62/38 |
| 2,964,914 | 12/1960 | Schuftan et al. | 62/38 |
| 3,277,655 | 10/1978 | Geist et al. | 62/28 |
| 3,292,380 | 12/1966 | Bucklin | 62/28 |
| 3,292,381 | 12/1966 | Bludworth | 62/28 |
| 3,360,944 | 1/1968 | Knapp et al. | 62/23 |
| 3,433,026 | 3/1969 | Swearingen | 62/23 |
| 3,626,448 | 12/1971 | Crawford | 62/23 |
| 3,808,826 | 5/1974 | Harper et al. | 62/28 |

*Primary Examiner*—Norman Yudkoff

*Attorney, Agent, or Firm*—Brumbaugh, Graves, Donohue & Raymond

[57] ABSTRACT

A process for separating hydrocarbon gases is described for the recovery of gases such as ethane and heavier hydrocarbons from natural gas streams or similar refinery or process streams. In the process described, the gas to be separated is cooled at a high pressure to produce partial condensation. The liquid from the partial condensation is further cooled and then expanded to a lower pressure. At the lower pressure, the liquid is then separated into fractions in a distillation column. The basic separation process is improved by combining the condensed high-pressure liquid with a stream having a lower bubble point, with cooling of one or both streams prior to expansion.

32 Claims, 9 Drawing Figures

30.
20.
10.
9.
8.
7.
6.
5.
4.
3.
2.
1.
MOLE % $CO_2$
250 PSIA
LIQUID
SOLID-LIQUID PHASE EQUILIBRIUM
VAPOR
SOLID-VAPOR PHASE EQUILIBRIUM
-80
-100
-120
-140
-160
-180
TEMPERATURE °F 4.
3.
2.
1.
.9
.8
.7
.6
.5
MOLE % $CO_2$
250 PSIA
LIQUID
SOLID-LIQUID PHASE EQUILIBRIUM
VAPOR
SOLID-VAPOR PHASE EQUILIBRIUM
-80
-100
-120
-140
-160
-180
TEMPERATURE °F

HYDROCARBON GAS PROCESSING

This application is a continuation-in-part of our co-pending application, Ser. No. 728,963, filed Oct. 4, 1976, now abandoned, which, in turn, is a continuation-in-part of our co-pending application Ser. No. 712,771, filed Aug. 9, 1976 now abandoned.

This invention relates to the processing of gas streams containing hydrocarbons and other gases of similar volatility to remove desired condensable fractions. In particular, the invention is concerned with processing of gas streams such as natural gas, synthetic gas and refinery gas streams to recover most of the propane and a major portion of the ethane content thereof, together with substantially all of the heavier hydrocarbon content of the gas.

Gas streams containing hydrocarbons and other gases of similar volatility which may be processed according to the present invention include natural gas, synthetic gas streams obtained from other hydrocarbon materials such as coal, crude oil, naphtha, oil shale, tar sands, and lignite. The major hydrocarbon components of natural gas are methane and ethane, i.e., methane and ethane together comprise at least 50% (molar) of the gas composition. There may also be lesser amounts of the relatively heavier hydrocarbons such as propane, butanes, pentanes, and the like as well as $H_2$, $N_2$, $CO_2$, and other gases. A typical analysis of a natural gas stream to be processed in accordance with the invention would be, in approximate mol %, 80% methane, 10% ethane, 5% propane, 0.5% iso-butane, 1.5% normal butane, 0.25% iso-pentane, 0.25% normal pentane, 0.5% hexane plus, with the balance made up of nitrogen and carbon dioxide. Sulfur-containing gases are also often found in natural gas.

Recent substantial increases in the market for the ethane and propane components of natural gas has provided demand for processes yielding higher recovery levels of these products. Available processes for separating these materials include those based upon cooling and refrigeration of gas, oil absorption, refrigerated oil absorption, and the more recent cryogenic processes utilizing the principle of gas expansion through a mechanical device to provide power while simultaneously extracting heat from the system. Depending upon the pressure of the gas source, the richness (ethane and heavier hydrocarbons content) of the gas and the desired end products, each of these prior art processes or a combination thereof may be employed.

The cryogenic expansion type recovery process is now generally preferred for ethane recovery because it provides maximum simplicity with ease of start up, operating flexibility, good efficiency, safety, and good reliability. U.S. Pat. Nos. 3,360,944, 3,292,380, and 3,292,381 describe relevant processes.

In a typical cryogenic expansion type recovery process a feed gas stream under pressure is cooled by heat exchange with other streams of the process and/or external sources of cooling such as a propane compression-refrigeration system. As the gas is cooled, liquids are condensed and are collected in one or more separators as a high-pressure liquid feed containing most of the desired $C_2$+ components. The high-pressure liquid feed is then expanded to a lower pressure. The vaporization occurring during expansion of the liquid results in further cooling of the remaining portion of the liquid. The cooled stream comprising a mixture of liquid and vapor is demethanized in a demethanizer column. The demethanizer is a fractionating column in which the expansion-cooled stream is fractionated to separate residual methane, nitrogen and other volatile gases as overhead vapor from the desired products of ethane, propane and heavier components as bottom product.

If the feed stream is not totally condensed, typically it is not, the vapor remaining from this partial condensation is passed through a turbo-expander, or expansion valve, to a lower pressure at which additional liquids are condensed as a result of the further cooling of the stream. The pressure after the expansion is usually the same pressure at which the demethanizer is operated. Liquids thus obtained are also supplied as a feed to the demethanizer. Typically, remaining vapor and the demethanizer overhead vapor are combined as the residual methane product gas.

In the ideal operation of such a separation process the vapors leaving the process will contain substantially all of the methane found in the feed gas to the recovery plant, and substantially no hydrocarbons equivalent to ethane or heavier components. The bottoms fraction leaving the demethanizer will contain substantially all of the heavier components and essentially no methane. In practice, however, this ideal situation is not obtained for the reason that the conventional demethanizer is operated largely as a stripping column. The methane product in the process, therefore, typically comprises vapors leaving the top fractionation stage of the column together with vapors not subjected to any rectification step. Substantial losses of ethane occur because the vapors discharged from the low temperature separation steps contain ethane and heavier components which could be recovered if those vapors could be brought to lower temperatures or if they were brought in contact with a significant quantity of relatively heavy hydrocarbons, for example $C_3$ and heavier, capable of absorbing the ethane.

As described in our prior applications Ser. No. 698,065 filed June 21, 1976, Ser. No. 712,825 filed Aug. 9, 1976 (both now abandoned), and our co-pending application Ser. No. 728,962, filed Oct. 4, 1976, of Campbell, Wilkinson and Rambo, improved ethane recovery is achieved by cooling the condensed high-pressure liquid prior to expansion. Such cooling will reduce the temperature of the flash-expanded liquid feed supplied to the demethanizer and thus improve ethane recovery. Moreover, as described in the aforementioned applications, Ser. No. 698,065, Ser. No. 712,825, and Ser. No. 728,962, by pre-cooling the high pressure liquid feed, the temperature of the expanded liquid may be sufficiently reduced that it can be used as top column feed in the demethanizer, while the expanded vapor is supplied to the demethanizer at a feed point intermediate the top feed and column bottom. This variation permits recovery of ethane contained in the expanded vapor which would otherwise be lost.

It will be obvious that to supply external refrigeration at this stage of the process is difficult because of the extremely low temperatures encountered. In typical demethanizer operations the expanded liquid and vapor feeds are at temperatures in the order of −120° F. to −190° F. Accordingly, cooling of the condensed high-pressure liquid stream feed can best be achieved by heat exchange of the condensed high-pressure liquid stream feed with streams derived within the process as described in the above-identified applications Ser. No. 698,065, Ser. No. 712,825, and Ser. No. 728,962.

It will be recognized from the foregoing discussion that the high-pressure liquid feed generally contains volatile gases (such as methane), as well as gases of lower volatility and that cooling of the high-pressure liquid feed upon expansion results from vaporization of a portion of the volatile gases. In accordance with the present invention, the temperature drop obtained upon expansion of the high-pressure liquid feed can be increased by combining that feed with a process stream having a bubble point lower than the bubble point of the high-pressure liquid feed at the pressure to which the high-pressure feed is expanded. Prior to expansion, the combined stream is cooled to a temperature below the temperature of the high-pressure liquid feed.

This may be accomplished by cooling the high-pressure liquid stream or the gaseous process stream (or both) prior to combining them; or by cooling the combined streams if that is more convenient. Upon expansion, the combined stream will achieve a lower refrigerated temperature because of the presence of enhanced quantities of the more volatile components which reduces the bubble point of the combined stream and which vaporizes at the lowest pressure to absorb increased quantities of heat of vaporization.

It will be recognized that in practical situations, the bubble point temperature of the high-pressure liquid feed may be several degrees or more above its actual process temperature due to non-equilibrium conditions arising during the condensation and separation of high-pressure liquid and vapor feeds. Such a condition also arises when the high-pressure liquid feed is cooled in accordance with the invention disclosed in applications Ser. No. 698,085 of June 21, 1976, Ser. No. 712,825 dated Aug. 9, 1976, and Ser. No. 728,962 of Oct. 4, 1976, which are identified above. When the bubble point temperature significantly exceeds the actual process temperature of the high-pressure liquid feed, the temperature drop on expansion is less than the temperature drop which would be obtained by expanding a high-pressure liquid feed at its bubble point. In accordance with the present invention, such a high-pressure liquid feed can be combined with a more volatile process stream as described above, and with moderate further cooling, provide improved process operations. This is because addition of the gaseous process stream to the high-pressure liquid feed will result in absorption of volatile gases until the actual bubble point temperature of the high-pressure liquid feed can be reduced to the process temperature of the high-pressure liquid feed. Expansion of a liquid of such a reduced bubble point will result in colder refrigerated temperatures being achieved.

For a fuller understanding of this invention, reference may be had to the following drawings in which.

In the following explanation of the above figures, tables are provided summarizing flow rates calculated for representative process conditions. In the tables appearing herein, the values for flow rates (in pound moles per hour) have been rounded to the nearest whole number, for convenience. The total stream flow rates shown in the tables include all non-hydrocarbon components and hence are generally larger than the sum of the stream flow rates for the hydrocarbon components. Temperatures indicated are approximate values, rounded to the nearest degree.

Figure 1:
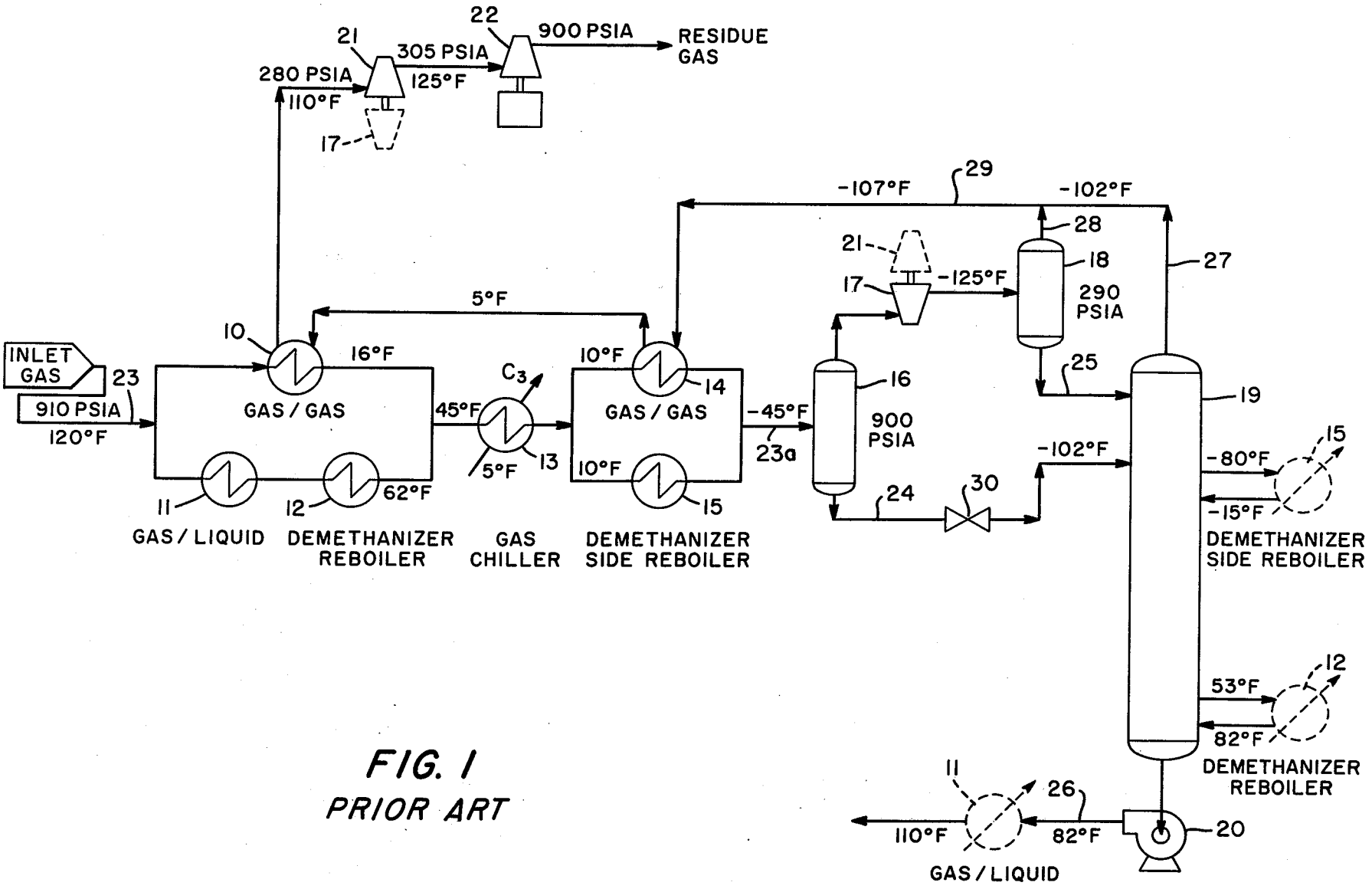
FIG. 1 PRIOR ART
FIG. 1 is a flow diagram of a single-stage cryogenic expander natural gas processing plant of the prior art incorporating a set of conditions for a typical rich natural gas stream.

Referring to FIG. 1, for a fuller description of a typical conventional ethane recovery process, plant inlet gas from which carbon dioxide and sulfur compounds have been removed (if the concentration of these compounds in the plant inlet gas would cause the product stream not to meet specifications, or cause icing in the equipment), and which has been dehydrated enters the process at 120° F. and 910 psia as stream 23. It is divided into two parallel streams and cooled to 45° F. by heat exchange with cool residue gas at 5° F. in exchanger 10; with product liquids (stream 26) at 82° F. in exchanger 11; and with demethanizer liquid at 53° F. in demethanizer reboiler 12. From these exchangers, the streams recombine and enter the gas chiller, exchanger 13, where the combined stream is cooled to 10° F. with propane refrigerant at 5° F. The cooled stream is again divided into two parallel streams and further chilled by heat exchange with cold residue gas (stream 29) at −107° F. in exchanger 14, and with demethanizer liquids at −80° F. in demethanizer side reboiler 15. The streams are recombined, as stream **23*a*, and enter a high-pressure separator 16 at −45° F. and 900 psia. The condensed liquid (stream 24) is separated and fed to the demethanizer 19 through expansion valve 30**. An expansion engine may be used in place of the expansion valve if desired.

The cooled gas from the high-pressure separator 16 flows through expander 17 where it is work expanded from 900 psia to 290 psia. The work expansion chills the gas to −125° F. Expander 17 is preferably a turbo-expander, having a compressor 21 mounted on the expander shaft. For convenience, expander 17 is sometimes hereinafter referred to as the expansion means. In certain prior art embodiments, expander 17 is replaced by a conventional expansion valve.

Liquid condensed during expansion is separated in low pressure separator 18. The liquid is fed on level control through line 25 to the demethanizer column 19 at the top and flows from a chimney tray (not shown) as top feed to the column 19.

It should be noted that in certain embodiments low pressure separator 18 may be included as part of demethanizer 19, occupying the top section of the column. In this case, the expander outlet stream enters above a chimney tray at the bottom of the separator section, located at the top of the column. The liquid then flows from the chimney tray as top feed to the demethanizing section of the column.

As liquid fed to demethanizer 19 flows down the column, it is contacted by vapors which strip the methane from the liquid to produce a demethanized liquid product at the bottom. The heat required to generate stripping vapors is provided by heat exchangers 12 and 15.

The vapors stripped from the condensed liquid in demethanizer 19 exit through line 27 to join the cold outlet gas from separator 18 via line 28. The combined vapor stream then flows through line 29 back through heat exchangers 14 and 10. Following these exchangers, the gas flows through compressor 21 driven by expander 17 and directly coupled thereto. Compressor 21 compresses the gas to a discharge pressure of about 305 psia. The gas then enters a compressor 22 and is compressed to a final discharge pressure of 900 psia.

Inlet and liquid component flow rates, outlet liquid recoveries and compression requirements for this prior art process shown in FIG. 1 are given in the following table:

TABLE I (FIG. 1)

STREAM FLOW RATE SUMMARY - LB. MOLES/HR.

| STREAM | METHANE | ETHANE | PROPANE | BUTANES+ | TOTAL |
|---|---|---|---|---|---|
| 23 | 1100 | 222 | 163 | 130 | 1647 |
| 24 | 795 | 202 | 157 | 129 | 1300 |
| 25 | 16 | 10 | 5 | 1 | 32 |
| 26 | 3 | 162 | 157 | 130 | 453 |

RECOVERIES

| | | |
|---|---|---|
| Ethane | 72.9% | 29,296 GAL/DAY |
| Propane | 96.2% | 39,270 GAL/DAY |

COMPRESSION HORSEPOWER

| | |
|---|---|
| Refrigeration | 256 BHP |
| Recompression | 892 BHP |
| Total | 1148 BHP |

Figure 2:
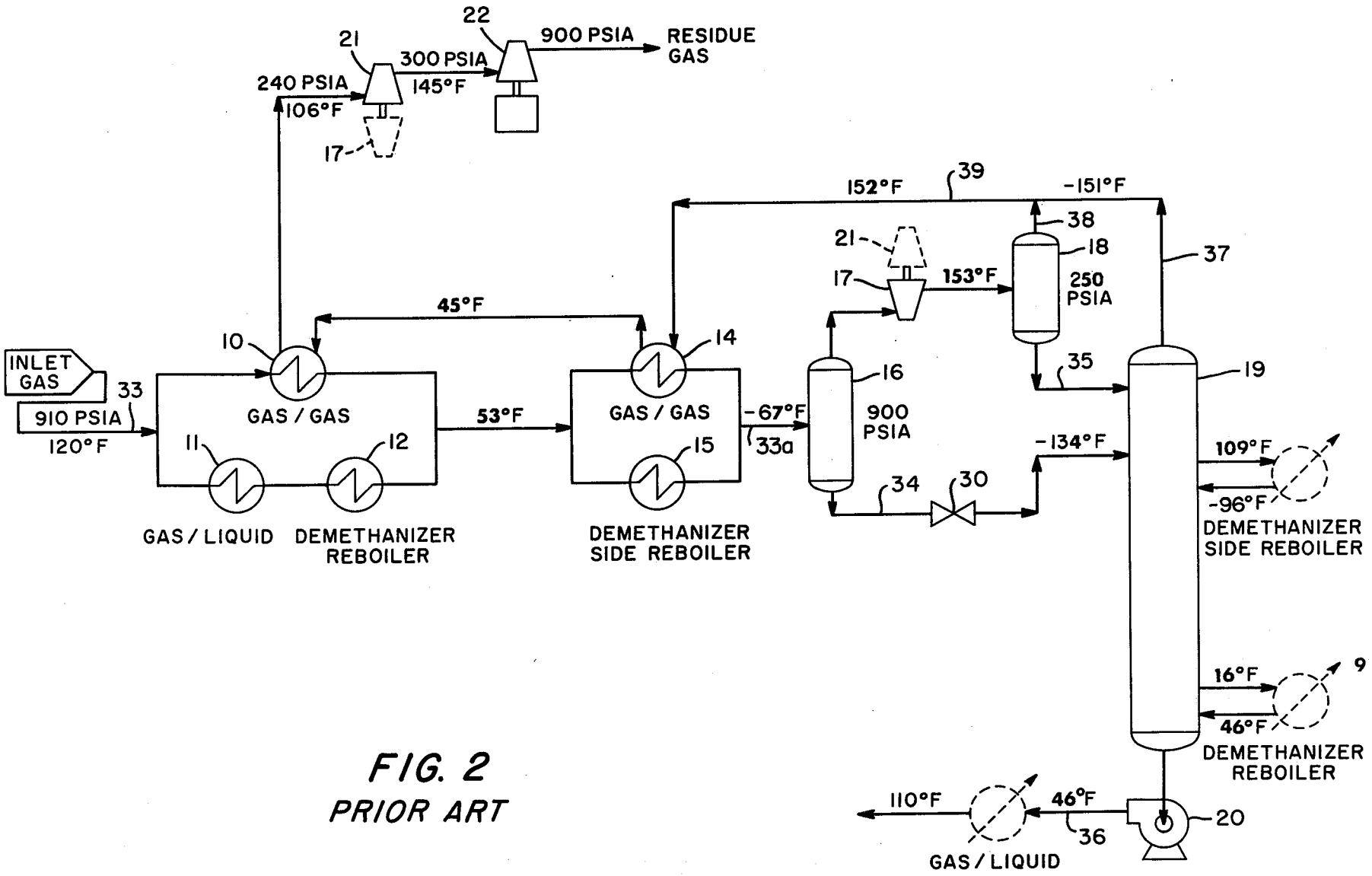
FIG. 2 PRIOR ART
FIG. 2 is a flow diagram of single-stage cryogenic expander natural gas processing plant of the prior art incorporating a set of conditions for a typical lean natural gas stream.

In FIG. 2 a typical lean natural gas stream is processed and cooled using a prior art process similar to that shown in FIG. 1. The inlet gas stream 33 is cooled to −69° F. and flows to high pressure separator 16 as stream **33*a* where the liquid contained therein is separated and fed on level control through line 34 and expansion valve 30 to demethanizer 19** in the middle of the column.

Cold gas from separator 16 flows through expander 17 where because of work expansion from 900 psia to 255 psia, the gas is chilled to −160° F. The liquid condensed during expansion is separated in low pressure separator 18 and is fed on level control through line 35 to the demethanizer 19 as top feed to the column.

The data for this case are given in the following table:

TABLE II (FIG. 2)

STREAM FLOW RATE SUMMARY - LB. MOLES/HR.

| STREAM | METHANE | ETHANE | PROPANE | BUTANES+ | TOTAL |
|---|---|---|---|---|---|
| 33 | 1447 | 90 | 36 | 43 | 1647 |
| 34 | 280 | 42 | 25 | 39 | 391 |
| 35 | 133 | 35 | 11 | 4 | 186 |
| 36 | 2 | 71 | 36 | 43 | 155 |

TABLE II-continued

RECOVERIES

| | | |
|---|---|---|
| Ethane | 79.0% | 17,355 GAL/DAY |
| Propane | 98.2% | 8,935 GAL/DAY |

COMPRESSION HORSEPOWER

| | |
|---|---|
| Refrigeration | 0 BHP |
| Recompression | 1180 BHP |
| Total | 1180 BHP |

In the prior art cases discussed with respect to FIG. 1 and FIG. 2 above, recoveries of ethane are 73% for the case of the rich gas feed and 79% for the lean gas feed. It is recognized that some improvement in yield may result by adding one or more cooling steps followed by one or more separation steps, or by altering the temperature of separator 16 or the pressure in separator 18. Recoveries of ethane and propane obtained in this manner, while possibly improved over the cases illustrated by FIG. 1 and FIG. 2, are significantly less than yields which can be obtained in accordance with the process of the present invention. By way of illustration the process conditions of FIG. 2 can be altered by reducing column pressure to 225 psia. At the lower pressure ethane and propane recoveries are somewhat increased (to 82.96% and 98.66%, respectively); however, the lower operating pressure requires a substantial increase in the horsepower requirements of the process to 1353 BHP.

Figure 3:
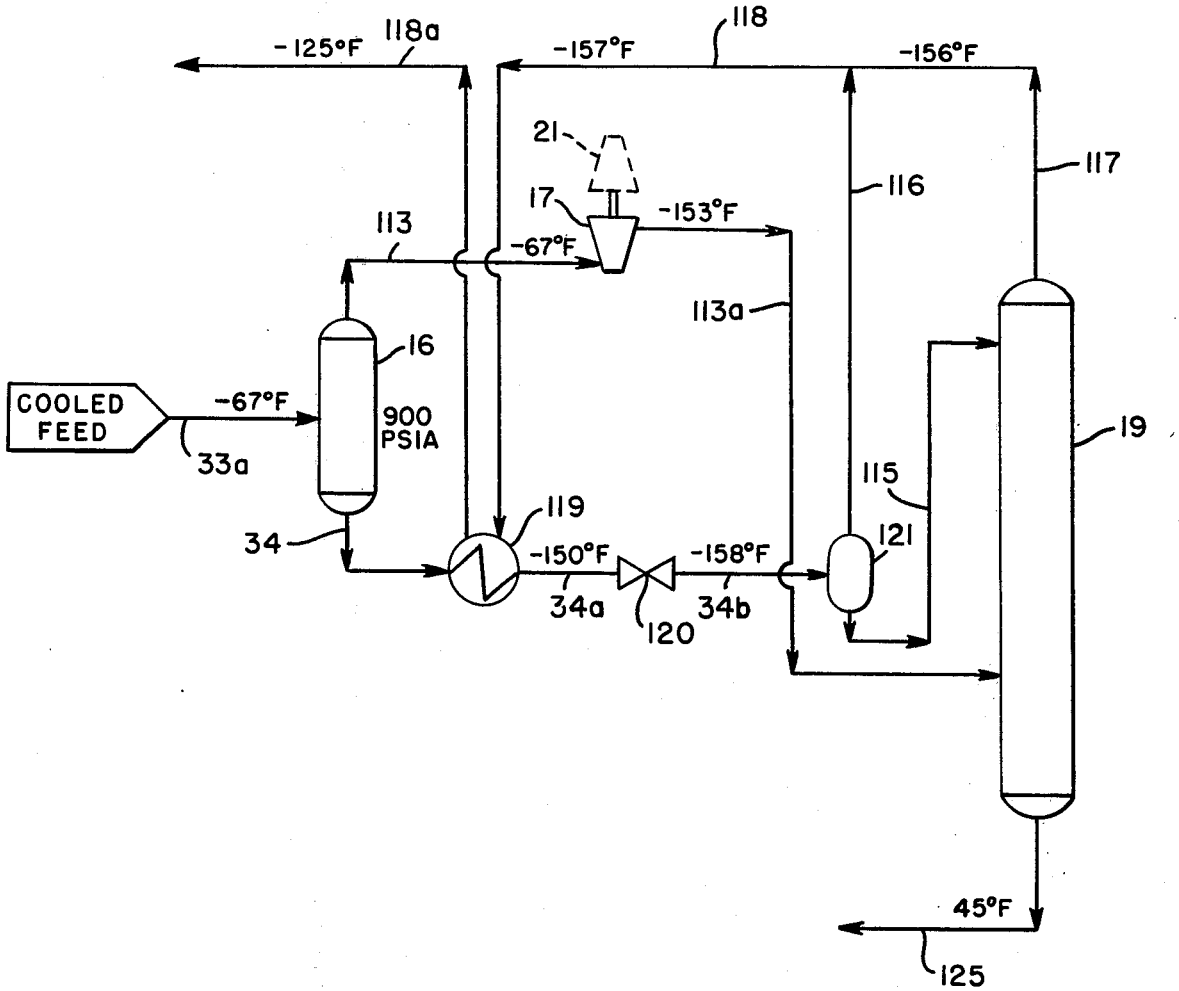
FIG. 3 is a flow diagram from companion application, Ser. No. 698,065, illustrating one technique by means of which high-pressure liquid feed gas can be pre-cooled prior to expansion.

FIG. 3 shows one means, as described in the above-identified applications, Ser. No. 698,065, Ser. No. 712,825, and Ser. No. 728,962, for pre-cooling the high-pressure liquid feed. In the process of FIG. 3, the partially condensed feed gas **33*a* at −67° F. and 900 psia is obtained as described in FIG. 2. The feed gas was assumed to be a lean feed gas of the composition of stream 33 in FIG. 2. The partially condensed gas 33*a* enters a high-pressure separator 16** where liquid and vapors are separated.

Following first the vapors 113 leaving separator 16, the vapors enter a work expansion engine 17 in which mechanical energy is extracted from the vapor portion of the high pressure feed. As the vapor is expanded from a pressure of about 900 psia to a pressure of about 250 psia, work expansion cools the expanded vapor 113 to a temperature of approximately −153° F. The expanded and partially condensed vapor 113 is supplied as a feed to demethanizer 19, wherein the vapor portion rises and forms part of demethanizer overhead 117. Demethanizer overhead 117 at a temperature of −156° F. combines with vapors 116 from flash vaporization described below to form residue gas stream 118. The combined, cold residue gas stream 118 then passes through heat exchanger 119. The warmed residue gas at −125° F. leaving heat exchanger 119 then returns to the preliminary cooling stages as illustrated, for example, in FIG. 2, wherein further refrigeration contained in the still cold vapor stream is recovered, and the vapor is compressed, via compressor 21 (see FIG. 2) which is driven by work expansion engine 17, and then further compressed to a line pressure of 900 psia by supplementary compressor 22.

Turning to the liquid 34 recovered from separator 16, liquid 34 passes through heat exchanger 119 in heat exchange relation with the cold residue gas 118. This results in a pre-cooling of the liquid portion of the partially condensed high pressure feed gas. The sub-cooled liquid is then expanded through an appropriate expansion device, such as expansion valve 120, to a pressure of approximately 250 psia. During expansion a portion of the feed will vaporize, resulting in cooling of the remaining part. In the process as illustrated in FIG. 3, the expanded stream leaving expansion valve 120 reaches a temperature of −158° F. and enters a separator. The liquid portion is separated and supplied as stream 115 to the fractionation column 19 as top feed. It may be noted that by comparison with FIG. 2, the expanded liquids through line 34 entering the demethanizer column only achieve a temperature of −134° F. Because stream 115 of FIG. 3 is substantially cooler, it may be used as top feed to the demethanizer to recover ethane in the stream 113. The ethane recovered is withdrawn in the demethanizer bottoms 125. Demethanizer bottoms 125 are heat exchanged with incoming feed to recover refrigeration therein as generally illustrated in FIGS. 1 and 2.

In connection with FIG. 3, it should be noted that for purposes of heat economy there will be one or more demethanizer reboilers which exchange heat to cool incoming feed (not shown in FIG. 3) as illustrated generally in FIGS. 1 and 2. For purposes of the illustrated process calculations appearing in FIG. 3 and set forth in the table below, two such reboilers have been included as shown in FIG. 2. The reboilers are significant to the overall heat economy of the process. Sub-cooling of the liquid stream 34 by overhead vapors 118 reduces the available refrigeration remaining in stream 118 for feed cooling purposes. However, the increased loading of demethanizer 19 with liquid stream 115 cooled in accordance with FIG. 3 provides additional available refrigeration in the reboilers. Accordingly, the overall heat balance of the process remains substantially unaffected.

Inlet and liquid component flow rates, outlet recovery efficiencies, and expansion/compression requirements for the process illustrated in FIG. 3 are set forth in the following table:

TABLE III (FIG. 3)

STREAM FLOW RATE SUMMARY - LB. MOLES/HR.

| STREAM | METHANE | ETHANE | PROPANE | BUTANES+ | TOTAL |
|---|---|---|---|---|---|
| 33a | 1447 | 90 | 36 | 43 | 1647 |
| 34 | 280 | 42 | 25 | 39 | 391 |
| 113 | 1167 | 48 | 11 | 4 | 1256 |
| 115 | 251 | 42 | 25 | 39 | 361 |
| 116 | 29 | 0 | 0 | 0 | 30 |
| 118 | 1445 | 10 | 1 | 0 | 1483 |
| 125 | 2 | 80 | 35 | 43 | 164 |

RECOVERIES

| | | |
|---|---|---|
| Ethane | 89.1% | 19,656 GAL/DAY |
| Propane | 97.7% | 8,894 GAL/DAY |

COMPRESSION HORSEPOWER

| | |
|---|---|
| Refrigeration | 0 BHP |
| Recompression | 1177 BHP |
| Total | 1177 BHP |

For purposes of further comparison with the present invention in the examples set forth below, a second base case was calculated following the flow plan of FIG. 3 and employing the same lean feed gas. In the modified flow plan, the feed gas to the process at 120° F. and 910 psia was cooled to −68° F. in the feed pre-coolers (for example, exchangers 10, 11, 12, 14 and 15 of FIG. 2) rather than −67° F. and the column was operated at slightly lower pressure, i.e., 240 psia rather than 250 psia. The result was a slight increase in recovery of ethane and propane, together with an increase in horsepower requirements for the process. A summary of the modified flow conditions and flow rates for the alternate base case is set forth in Table IV below:

TABLE IV (FIG. 3)

STREAM FLOW RATE SUMMARY - LB. MOLES/HR.

| STREAM | METHANE | ETHANE | PROPANE | BUTANES+ | TOTAL | CONDITIONS |
|---|---|---|---|---|---|---|
| 33a | 1447 | 90 | 36 | 43 | 1647 | −68° F.; 900 psia |
| 34 | 308 | 44 | 26 | 39 | 424 | −68° F.; 900 psia |
| 34a | 308 | 44 | 26 | 39 | 424 | −153° F.; 900 psia |
| 34b | 308 | 44 | 26 | 39 | 424 | −161° F.; 240 psia |
| 113 | 1139 | 46 | 10 | 4 | 1223 | −68° F.; 900 psia |
| 113a | 1139 | 46 | 10 | 4 | 1223 | −153° F.; 240 psia |
| 115 | 278 | 44 | 26 | 39 | 292 | −161° F.; 240 psia |
| 118 | 1446 | 8 | 1 | 0 | 1479 | −160° F.; 240 psia |
| 118a | 1446 | 8 | 1 | 0 | 1479 | −125° F.; 240 psia |
| 125 | 1 | 82 | 35 | 43 | 168 | 36° F. |

RECOVERIES

| | | |
|---|---|---|
| Ethane | 90.66% | 19,907 GAL/DAY |
| Propane | 98.08% | 8,928 GAL/DAY |

COMPRESSION HORSEPOWER

| | |
|---|---|
| Refrigeration | 0 BHP |
| Recompression | 1258 BHP |
| Total | 1258 BHP |

EXAMPLE 1

Figure 4:
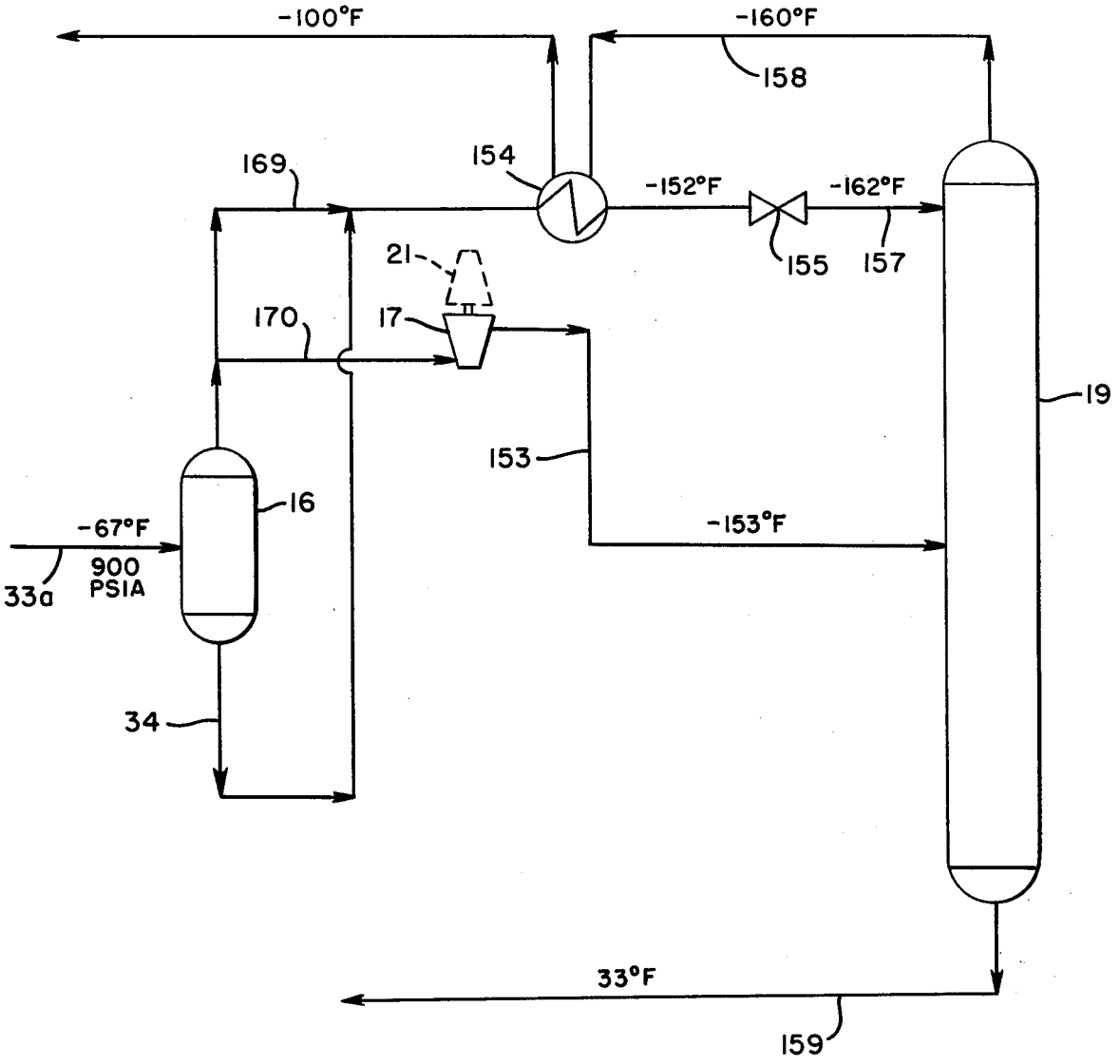
FIG. 4 is a flow diagram illustrating the application of the present invention to a feed pre-cooling process as described in FIG. 3.

The present invention is illustrated by the following example which should be considered in conjunction with FIG. 4. FIG. 4 is a fragmentary flow diagram wherein a lean feed gas 33a at 900 psia is cooled to −67° F. and supplied to separator 16. The feed gas is cooled and partially condensed by heat exchange with various process streams (these heat exchangers not being shown), including side reboilers on the demethanizer column 19 (side reboilers now shown), heat exchange with demethanizer bottoms and product gas as described in FIG. 2. If necessary, as indicated in FIGS. 1 and 2, supplementary external refrigeration may also be provided. The process conditions described in FIG. 4 and the flow rates set forth in Table V below, correspond to the process of a lean feed gas of the composition set forth in Table II and FIG. 2.

Following the process of FIG. 4, the partially condensed gas 33a containing a liquid portion and a vapor portion, enters high pressure separator 16 where the liquid portion is separated. The liquid from separator 16 (stream 34) is combined with a portion of the vapor from separator 16 (stream 169). The combined stream then passes through heat exchanger 154 in heat exchange relation with the overhead vapor stream 158 from the demethanizer resulting in cooling and condensation of the combined stream. The cooled stream is −152° F. is then expanded through an appropriate expansion device, such as expansion valve 155, to a pressure of approximately 250 psia. During expansion a portion of the feed will vaporize, resulting in cooling of the remaining part. In the process illustrated in FIG. 4, the expanded stream 157 leaving expansion valve 155 reaches a temperature of −162° F., and is supplied to the fractionation column 19 as top feed.

The remaining vapor from separator 16 (stream 170) enters a work expansion engine 17 in which mechanical energy is extracted from this portion of the high pressure feed. As that vapor is expanded from a pressure of about 900 psia to a pressure of about 250 psia, the work expansion cools the expanded vapor 153 to a temperature of approximately −153° F. The expanded and partially condensed vapor 153 is supplied as feed to demethanizer 19 at an intermediate point.

It may be noted that by comparison with the first base case of FIG. 3 the liquid 115 of said FIG. 3 entering the demethanizer column achieves a temperature of about −158° F. To achieve a lower temperature of −161° F. at the column top in the alternate base case, a reduced column pressure was necessary. The reduced column pressure increased horsepower requirement, but only slightly improved yield. In FIG. 4, as a result of combining the liquid 34 from separator 16 with a portion of the high pressure feed vapor 169 prior to sub-cooling in heat exchanger 154, the colder demethanizer top feed of −162° F. can be realized without lowering the demethanizer pressure.

Inlet and liquid component flow rates, outlet recoveries, and expansion/compression requirements for the process of Example 1 are set forth in the following Table V.

TABLE V (FIG. 4)

STREAM FLOW RATE SUMMARY - LB. MOLES/HR.

| STREAM | METHANE | ETHANE | PROPANE | BUTANES+ | TOTAL |
|---|---|---|---|---|---|
| 33a | 1447 | 90 | 36 | 43 | 1647 |
| 34 | 280 | 42 | 25 | 39 | 391 |
| 157 | 444 | 48 | 27 | 40 | 567 |
| 158 | 1445 | 7 | 1 | 0 | 1476 |
| 159 | 2 | 83 | 35 | 43 | 171 |
| 169 | 164 | 6 | 2 | 1 | 176 |
| 170 | 1003 | 42 | 9 | 3 | 1080 |

RECOVERIES

| | | |
|---|---|---|
| Ethane | 92.2% | 20,261 GAL/DAY |
| Propane | 98.3% | 8,949 GAL/DAY |

COMPRESSION HORSEPOWER

| | |
|---|---|
| Refrigeration | 0 BHP |
| Recompression | 1221 BHP |
| Total | 1221 BHP |

Comparison of the ethane and propane recoveries as between Tables III and V shows that in the absence of enriching the liquids from separator 16 ethane recovery is 89.1% and propane recovery is 97.7%. Enrichment of the separator liquids in accordance with Example 1 (see FIG. 4) increases ethane and propane recoveries to 92.5% and 98.3%, respectively.

Comparison of Tables IV and V further shows that the improvement in yields obtained in the present process was not simply the result of increasing the horsepower requirements. To the contrary, Table IV shows that even when the process conditions of the base case were altered to supply the demethanizer at a lower pressure, thus increasing horsepower requirements of the base case to 1258 horsepower, ethane and propane recovery increased only to 90.66% and 98.08%, respectively. When the present invention was employed, as in Example 1, ethane and propane recoveries increased over those set forth in the alternate base case, even though somewhat less horsepower was actually required.

From a preferred design standpoint in the practice of this invention, particularly for leaner gases, all of the liquid from separator 16 will be combined with some portion of the vapor from separator 16. The combined stream will then be cooled and expanded as described. The amount of vapor employed in the combined stream will be sufficient that the combined stream will provide the cooling duty and temperature needed to control the top temperature of the demethanizer. The liquids from separator 16, when added to the vapor forming the top column feed, increase the surface tension of the feed at column condition, thereby minimizing the formation of small liquid particles which are difficult to separate from the top vapor stream.

For richer gases, where there is more liquid from separator 16 than required to maintain the column top condition, it may be more economical from a design standpoint to divide the liquid from separator 16, and to expand a portion directly into the tower, or possibly after some sub-cooling. This may make possible savings in heat exchange requirements and higher recovery.

As set forth in the above-mentioned applications, Ser. No. 698,065, Ser. No. 712,825, and Ser. No. 728,962, there are a variety of modified flow plans characterized by sub-cooling of some or all of the liquid feed obtained from separator 16 to which the present invention is applicable. Two or more of these techniques may be used concurrently. Among these flow plans are the following:

1. Uncondensed vapors leaving separator 16 may be expanded such as in a work expansion engine to produce a cold partially condensed liquid and gas. The liquids are separated and supplied to the demethanizer column. All or a portion of the liquid thus separated may be used as a source of refrigeration for sub-cooling liquid condensate 34 recovered in separator 16. Alternatively, all or a portion of the entire expanded vapor stream may be used. Additionally, side demethanizer reboilers may be used to provide sub-cooling of condensate 34 from separator 16. In accordance with the present invention, flow plans can be modified by combining liquid condensate from separator 16 with a portion of the vapors from that separator prior to sub-cooling and flashing of the liquid condensate.

2. Liquid condensate from separator 16 may be directed through a sub-cooling heat exchanger and thence to an expansion valve wherein it is expanded from line pressure (e.g., 900 psia as in FIGS. 1-4) to demethanizer column operating pressure. This will result in a vapor-liquid mixture which can be separated either in a separate low pressure separator or may be fed directly to the demethanizer column with column internals designed to effect the necessary vapor-liquid separation. The flashing results in further cooling of the feed to the column. A portion of the further cooled liquid thereby obtained is employed as the coolant in heat exchange with the high pressure condensate from separator 16 and then supplied to the demethanizer column as a second feed at an intermediate point in the column. In accordance with the present invention, such a process can be improved by enriching the liquid condensate leaving separator 16 with a portion of the vapors from that separator prior to sub-cooling and flashing of the liquid condensate.

3. The uncondensed vapor leaving separator 16 may be expanded such as in a work expansion engine from a high pressure (e.g., 900 psia as in FIGS. 1-4) to the operating pressure of the demethanizer and the entire cooled gas-liquid mixture resulting from expansion may be usd to sub-cool the condensate recovered in separator 16. The sub-cooled condensate is thereafter flashed and is supplied to the demethanizer as a feed. This embodiment may be improved by enriching the liquid condensate recovered from separator 16 with a portion of the vapors leaving that separator prior to sub-cooling and flashing of the liquid condensate.

In lieu of or in addition to the foregoing additional external refrigeration may be provided if increased yields are required; however, one of the advantages of the invention described in said applications Ser. No. 698,065, Ser. No. 712,825, and Ser. No. 728,962 is that where the condensate is sub-cooled, improved yields frequently may be obtained without the necessity of increasing process horsepower requirements.

Still another embodiment of the present invention is set forth in the following example, which should read in conjunction with related FIG. 5.

EXAMPLE 2

Figure 5:
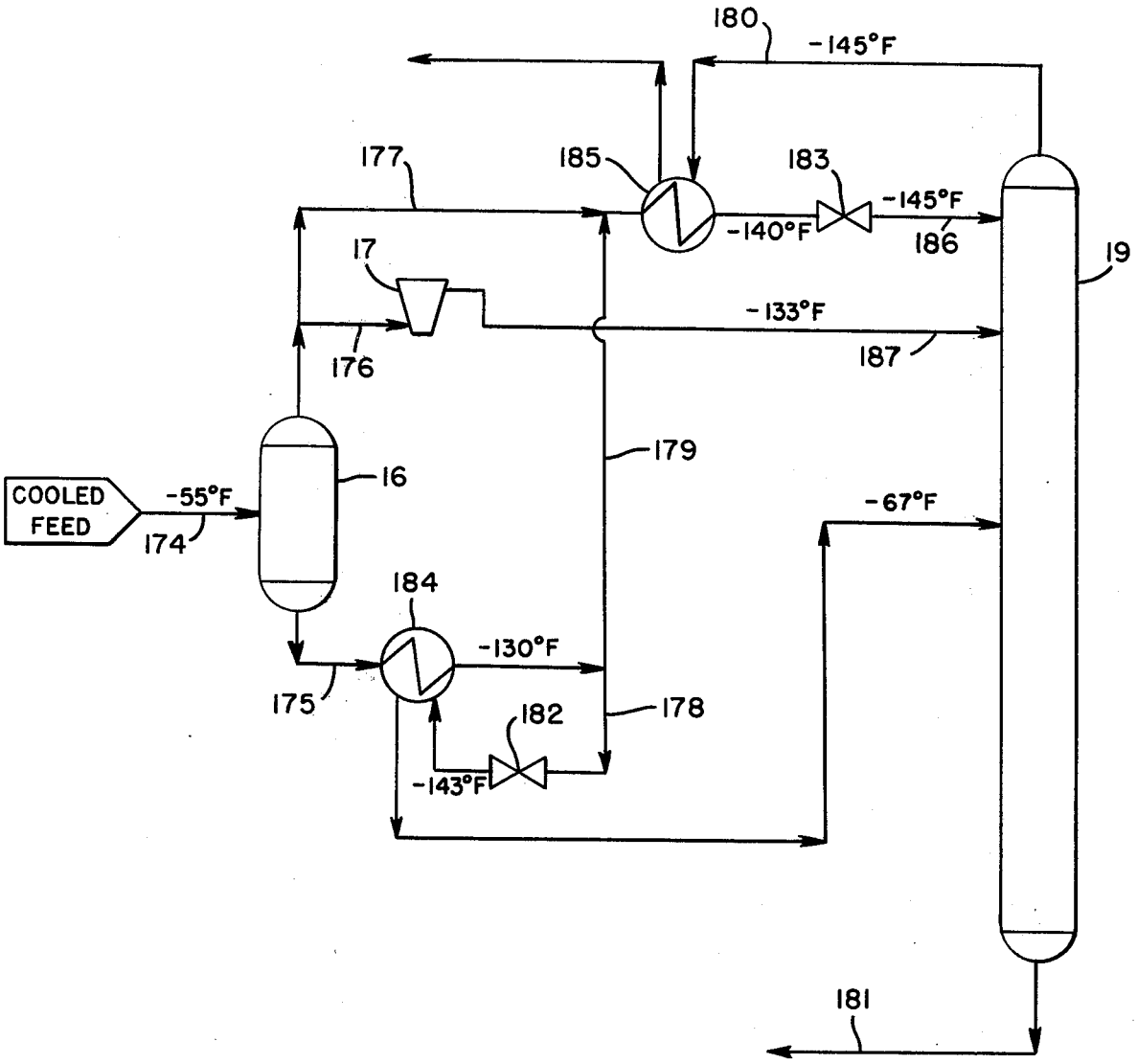
FIG. 5 is a fragmentary flow diagram of the application of the present invention to a feed pre-cooling process wherein the liquid feed is pre-cooled by a flash-expanded portion of said liquid feed.

FIG. 5 is a fragmentary flow process diagram for recovery of ethane and heavier components from a hydrocarbon feed gas containing methane, ethane and heavier hydrocarbons. As illustrated in FIG. 5, a partially condensed high-pressure feed gas 174 is provided to a separator 16 at −55° F. and 900 psia. Cooling of the feed gas to −55° F. may be provided as shown, for example, in FIGS. 1 and 2 by heat exchange to the feed gas with residue methane gas and other process streams such as demethanizer side reboilers and bottom streams (these heat exchangers not being shown), and, if necessary, with appropriate external refrigeration. For purposes of calculations on which this example is based, two demethanizer reboilers have been assumed. However, in contrast to FIGS. 1 and 2, the process calculations (e.g., temperature, pressure and flow rates have been based on an assumed gaseous feed intermediate in composition between the lean and rich case gases set forth in FIGS. 1 and 2 and Tables I and II.

As indicated in accompanying FIG. 5, the liquid and vapor portions of the partially condensed feed 174 are separated in separator 16. The vapor from separator 16 is divided into two portions. The first portion 176 flows through expander 17 where, because of work expansion from 900 to 290 psia, it is cooled to −133° F. From expander 17 the chilled vapor flows to demethanizer 19 as its middle feed. The second vapor portion 177 is combined with a portion of the sub-cooled liquid from heat exchanger 184 as it flows to heat exchanger 185.

The liquid 175 from separator 16 flows through exchanger 184 where it is sub-cooled to −130° F. by heat exchange with the cold stream from expansion valve 183. The sub-cooled liquid is then divided into two portions. The first portion 178 flows through expansion valve 182 where it undergoes expansion and flash vaporization as the pressure is reduced from about 900 to 290 psia. The cold stream from expansion valve 182 then flows through exchanger 184 where it is used to sub-cool the liquids from separator 16. From exchanger 184, the stream flows to demethanizer 19 as its lowest feed at −67° F.

The remaining liquid portion 179 from exchanger 184, still at high pressure, combines with a portion 177 of the vapor stream from separator 16. The combined stream then flows through heat exchanger 185 where it is cooled to approximately −140° F. by heat exchange with column overhead stream 180. At this temperature, the combined stream is substantially condensed. The condensed stream then enters expansion valve 183 where it undergoes expansion and flash vaporization as the pressure is reduced from 895 psia to 290 psia. From expansion valve 183 the cold stream proceeds to demethanizer 19 as its top feed.

Inlet and liquid component flow rates, outlet recovery efficiencies, and expansion/compression requirements for the embodiment of this invention as illustrated in FIG. 5 are given in the following table:

TABLE V (FIG. 5)

STREAM FLOW RATE SUMMARY - LB. MOLES/HR.

| STREAM | METHANE | ETHANE | PROPANE | BUTANES+ | TOTAL |
|---|---|---|---|---|---|
| 174 | 1304 | 162 | 80 | 54 | 1647 |
| 175 | 486 | 109 | 66 | 51 | 723 |
| 176 | 723 | 47 | 12 | 2 | 817 |
| 177 | 95 | 6 | 2 | 1 | 107 |
| 178 | 243 | 54 | 33 | 26 | 361 |
| 179 | 243 | 55 | 33 | 25 | 362 |
| 180 | 1301 | 14 | 1 | 0 | 1362 |
| 181 | 3 | 148 | 79 | 54 | 285 |

RECOVERIES

| | | |
|---|---|---|
| Ethane | 91.47% | 36,039 GAL/DAY |
| Propane | 98.38% | 19,732 GAL/DAY |

HORSEPOWER REQUIREMENTS

| | |
|---|---|
| Refrigeration | 130 BHP |
| Recompression | 987 BHP |
| Total | 1117 BHP |

It is noted that in addition to the procedure outlined in FIG. 5 for handling the cooled liquid 175 from separator 16, other alternate procedures may be used in some situations to advantage. One alternate procedure involves carrying a portion of the cooled liquid 179 directly from the separator through another expansion valve directly into the demethanizer column 19 at intermediate level.

In a second alternate procedure, the liquid 175 from separator 16 can be sub-cooled by residue gas instead of auto refrigeration as illustrated in FIG. 5. In this alternate, high pressure condensate may be cooled in two successive heat exchangers, each employing residue gas as one refrigerant. After passage through the first exchanger, partly cooled high pressure condensate is divided into two parts. The first part is expanded through an expansion valve and supplied to the demethanizer column 19 as an intermediate feed. The second part of the partly cooled condensate continues through the second exchanger where it is further cooled and then combined with vapor from separator 16. The combined stream is then further cooled and expanded whereafter it is supplied to the column 19 as top feed. Alternatively, vapor from separator 16 could be added to the second part of the partly cooled liquid stream before entering the second exchanger, thus eliminating the need for subsequent cooling of the combined stream.

In still another modification of the present invention, the flash-expanded stream, such as stream 186 of FIG. 5, may be directed into heat exchange relation with the work expanded vapor stream 187, thus cooling stream 187 and warming stream 186. If stream 187 is thus cooled sufficiently, it may be advantageous to employ stream 187 as the top feed to the demethanizer and stream 186 as an intermediate feed since, as is evident from the process flow plan of FIG. 5, stream 186 is richer in heavier components, i.e., $C_2+$, and stream 187 contains more lighter components, e.g., methane and uncondensed gases.

Other alternate procedures for obtaining the cooled liquid 175 are described in aforementioned applications Ser. No. 698,065, Ser. No. 712,825, and Ser. No. 768,962. These alternate procedures may be used in various combinations, when appropriate. Also, these various schemes may be used in place of or in conjunction with cooling provided by residue gas to the enriched stream, prior to its use as top feed to the column 19.

These alternate procedures are particularly useful when, because of the richness of the feed to the process, the cooling capacity of the overhead gas stream 180 is insufficient to cool the entire volume of liquid recovered through line 175 to the desired low temperature.

As is well known, natural gas streams usually contain carbon dioxide, sometimes in substantial amounts. The presence of carbon dioxide in the demethanizer can lead to icing of the column internals under cryogenic conditions. Even when feed gas contains less than 1% carbon dioxide, it fractionates in the demethanizer and can build up to concentrations of as much as 5% to 10% or more. At such high concentrations, carbon dioxide can freeze out depending on temperatures, pressure, whether the carbon dioxide is in the liquid or vapor phase, and the liquid phase solubility.

In the present invention it has been found that when the vapor from the high-pressure separator is expanded and supplied to the demethanizer below the top column feed position the problem of carbon dioxide icing ca be substantially mitigated. The high-pressure separator gas typically contains a large amount of methane relative to the amount of ethane and carbon dioxide. When supplied at a mid column feed position, therefore, the high-pressure separator gas tends to dilute the carbon dioxide concentration, and to prevent it from increasing to icing levels.

EXAMPLE 3

The advantage of the present invention can be readily seen by plotting carbon dioxide concentration and temperature for various trays of the demethanizer. To illustrate the preparation of such a chart the flow process illustrated in FIG. 4 was applied to the treatment of 6588 moles/hr of a feed gas of the following composition:

| Feed Gas Composition | |
|---|---|
| Methane | 93.82 |
| Ethane | 3.16 |
| Propane | 1.06 |
| Butane+ | .80 |
| $CO_2$ | .59 |
| $N_2$ | .57 |

The principal operating conditions for the process were the following:

| | |
|---|---|
| Pressure in high-pressure separator 16 | 895 psia |
| Temperature of high-pressure separator 16 | 0° F. |
| % of feed condensed in separator 16 | .44% |
| % of gas from separator 16 to expander 17 | 60% |
| Temperature of combined stream to expansion valve 155 | −120° F. |
| Temperature of expansion valve outlet | −147° F. |
| Column overhead temperature | −145° F. |
| Temperature of gas from expander 17 | −83° F. |
| Pressure in demethanizer | 360 psia |
| % ethane recovery | 87.33% |
| % propane recovery | 97.05% |
| Horsepower: | |
| Recompression 3194 BHP | |
| Refrigeration 0 BHP | |
| Total 3194 BHP | |

For base-case purposes the same feed gas was treated also in accordance with the process of FIG. 2. However, for more efficient utilization of available heat duty, the feed pre-cooling exchangers prior to the high-pressure separator were slightly rearranged. The principal operating parameters were the following:

| | |
|---|---|
| Pressure in high-pressure separator 16 | 895 psia |
| Temperature in high-pressure separator 16 | −70° F. |
| % of feed gas condensed in separator 16 | 2.95% |
| Temperature of expanded gases leaving expander 17 | −136° F. |
| Temperature of expanded liquid leaving flash valve 30 | −116° F. |
| Temperature of demethanizer overhead vapor | −134° F. |
| Pressure of demethanizer | 360 psia |
| % ethane recovery | 60.55% |
| % propane recovery | 90.58% |
| Horsepower: | |
| Recompression 3074 BHP | |
| Refrigeration 0 BHP | |
| Total 3074 BHP | |

Figure 6A:
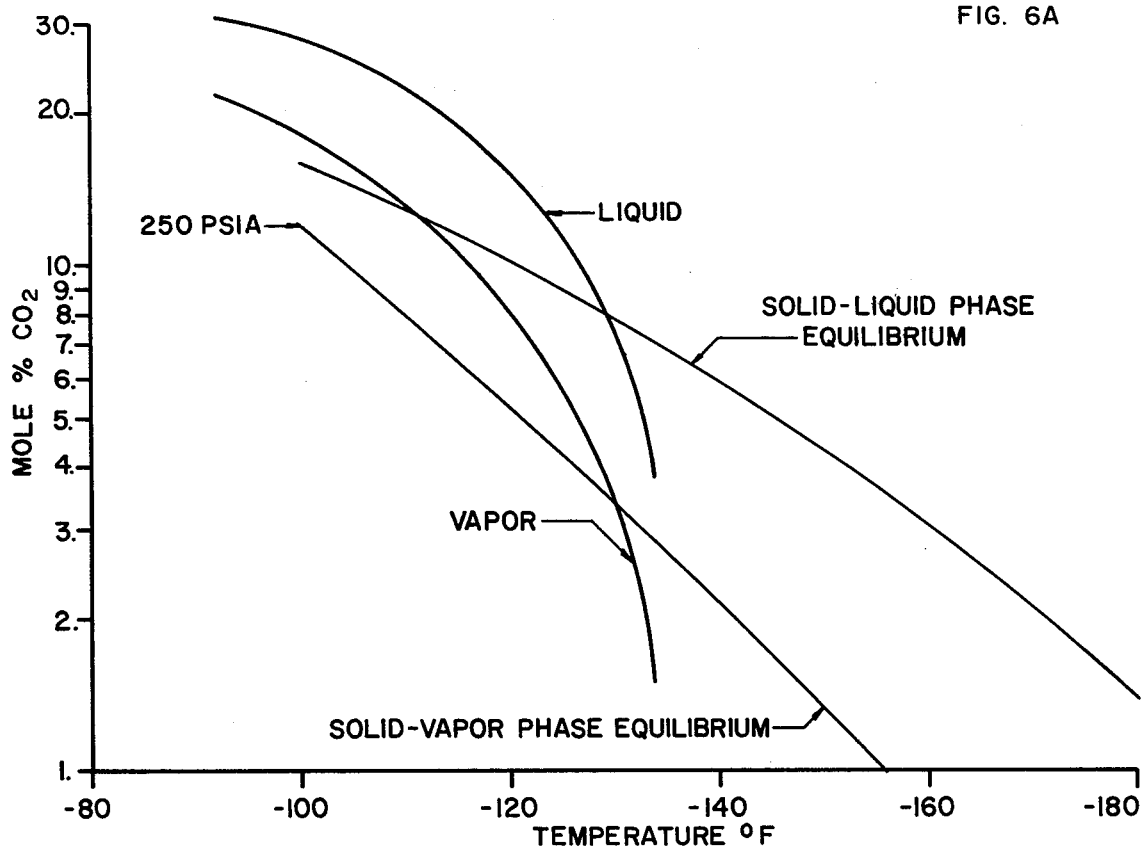
FIGS. 6A and 6B are graphs of carbon dioxide vs. temperature from one embodiment of this invention compared to the prior art.
Figure 6B:
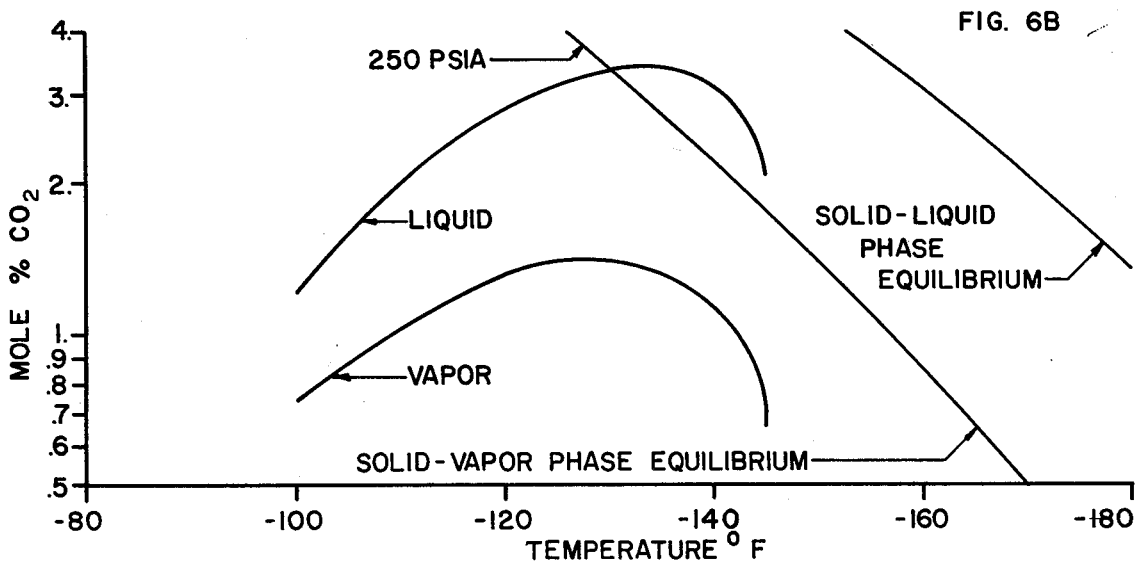

Plots were made for each of these cases of $CO_2$ concentration as a function of temperature in the demethanizer, as shown in FIGS. 6A and 6B. Also shown on these figures are the liquid-solid and vapor-solid equilibria. The equilibrium data given in FIGS. 6A and 6B are for the methane-carbon dioxide system. Warren E. White, Carl M. Ferunczy and Ned P. Baudat, "Short-Cut to $CO_2$ Solubility", *Hydrocarbon Processing*, August 1973. These data are considered generally representative for the methane and ethane systems. If the $CO_2$ concentration at a particular temperature in the column is at or above the equilibrium line at that temperature, icing can be expected. For practical design purposes, the engineer usually requires a margin of safety, i.e., the actual concentration should be less than the "icing" concentration by a suitable safety factor.

FIG. 6A shows that in the process of FIG. 2 the carbon dioxide concentration in the demethanizer rose well above the tolerable level. Such a gas could not be used in a conventional process, therefore, without pretreating it to remove a substantial amount of the carbon dioxide. By contrast, FIG. 6B shows that when the expanded vapors are employed as a mid column feed in accordance with the present invention, the $CO_2$ concentration is reduced in the demethanizer to a point well below the "icing" level.

It should be noted in connection with the foregoing that when designing demethanizer columns for use in the present invention, the designer will routinely verify that icing in the column will not occur. Even when vapor is fed at a mid-column position it is possible that icing may occur if the process is designed for the highest possible ethane recovery. Such designs normally call for the coldest practical temperature at the top of the column. This will result in the carbon dioxide concentration shifting to the right on the plots of FIGS. 6A and 6B. Depending on the particular application, the result can be an objectionably high concentration of carbon dioxide near the top of the column. For such circumstance, it may be necessary to accept a somewhat lower ethane recovery to avoid column icing, or to pre-treat the feed gas to reduce carbon dioxide levels to the point where they can be tolerated in the demethanizer. In the alternative, it may be possible to avoid icing in such a circumstance by other modifications in the process conditions. For instance, it may be possible to operate the high-pressure separator at a higher temperature, to increase the relative amount of gas from the high-pressure separator which is expanded through expander 17, or to expand a part of the vapors from the high-pressure separator through an isenthalpic expansion valve. If such alterations can be made within the limitations of the process heat balance, icing may be avoided without losing ethane recovery.

In connection with the process described above, it should be noted that in some instances the feed to the top of the demethanizer is a liquid which is expanded from a high pressure to the pressure of the demethanizer (see, for example, FIGS. 4 and 5). In such cases, it may be desirable to autocool the top column liquid feed. This is accomplished by dividing the top column liquid feed into two streams either before or after expansion. (Both streams are expanded if the top column feed is divided before expansion). One of the two expanded streams thus obtained is directed into a heat exchange relation with the top column feed prior to expansion.

In carrying out the present invention, it is important that at least part of the high-pressure vapor remaining after cooling and partial condensation of the feed be expanded in a work expansion engine to the demethanizer and supplied as a mid-column feed. There are two reasons for this:

(1) Extraction of work energy from the high-pressure vapor stream by expansion in a work engine provides a significant amount of refrigeration to the process. If work is not extracted from this stream, it is necessary to supply external refrigeration and, because of the low temperatures required, providing that refrigeration may become uneconomic. Additionally, recompression requirements are increased, since if the high pressure vapor is work expanded to cool it the energy extracted is available to supply some of the recompression requirements of the process.

(2) The vapor supplied to the mid-column feed position serves to dilute the carbon dioxide present in the liquids supplied to the top of the column. If the carbon dioxide is not diluted, it will tend to accumulate in the upper stages of the column and cause $CO_2$ icing.

(It should be noted that where rich gases are processed, the liquifaction temperature may be sufficiently high that total condensation can be practical, as shown in the above-mentioned application Ser. No 728,962 of Oct. 4, 1976).

The importance of utilizing at least a portion of the high-pressure vapor stream in a work expansion engine may be seen by the following illustrative case, in which the feed gas of Example 3 is processed. In the illustrative case, all of the high-pressure vapor is recombined with the high-pressure liquid condensation prior to flash expansion of the latter to the fractionation column.

Figure 7:
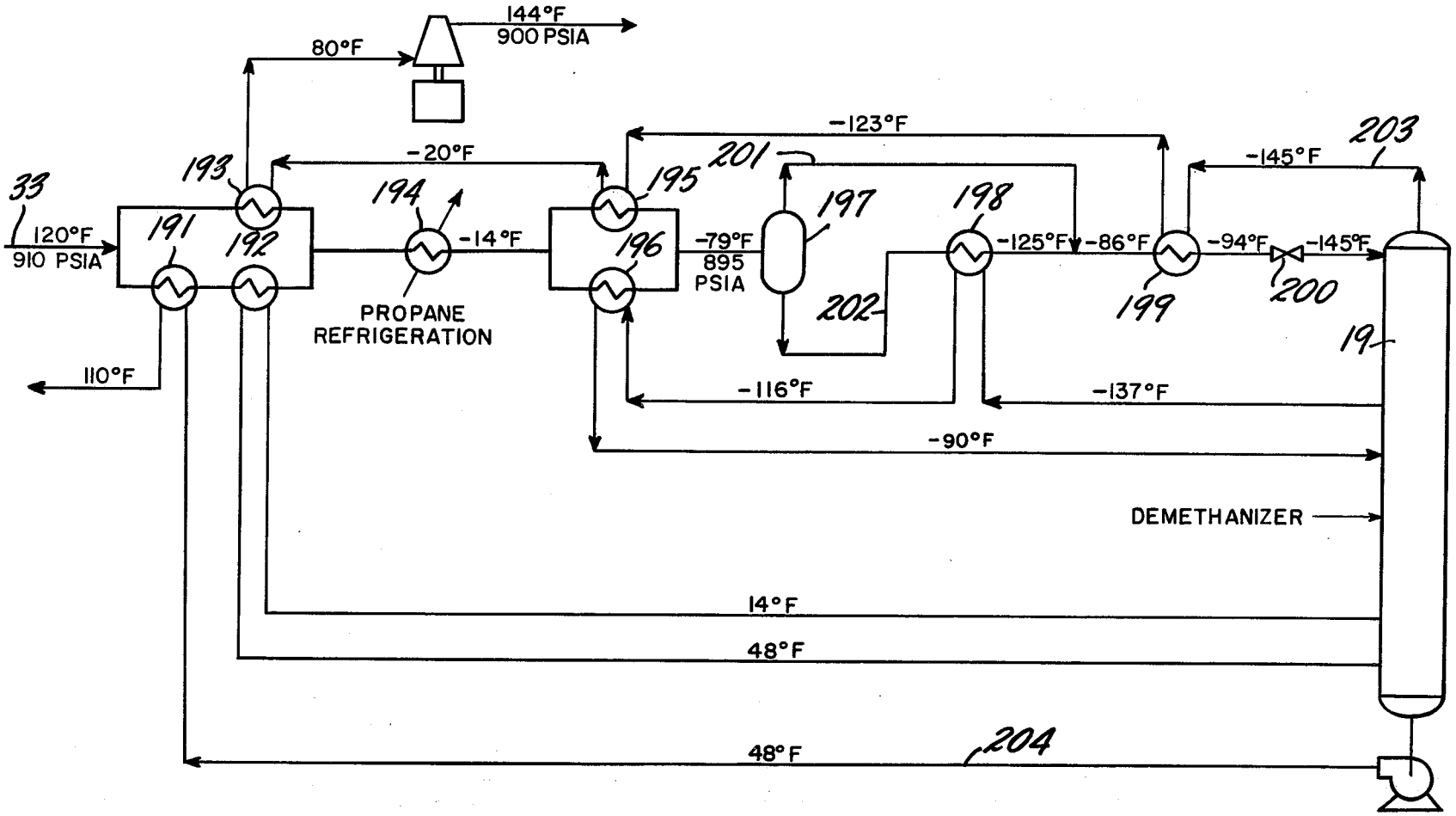
FIG. 7 is a process flow plan illustrating the importance of work expanding at least part of the high-pressure vapor.

In explaining this illustrative case, reference will be made to FIG. 7. As shown in FIG. 7, incoming feed is cooled by heat exchange with product liquid (exchanger 191), demethanizer reboiler (exchanger 192) and partially warmed residue gas (exchanger 193). The feed is further cooled by external propane refrigeration to −14° F. (exchanger 194). Additional cooling is extracted from residue gas (exchanger 195) and from demethanizer column liquids in a side reboiler (exchanger 196). In this manner, the major portion of the incoming feed gas is cooled and supplied to separator 197 at −79° F. and 895 psia. Liquid from separator 197 is further cooled in heat exchanger 198, and then recombined with vapor therefrom. Separate cooling of the liquid permits advantageous design of the liquid-liquid heat exchanger (see, for example, the discussion of this in U.S. Pat. No. 3,874,184 to Harper et al.) The recombined stream is further cooled in exchanger 199 to −94° F., flash expanded to the demethanizer pressure of 250 psia in flash valve 200 and supplied as the top column feed to demethanizer 19 at −145° F.

Inlet and liquid component flow rates, outlet recovery and expansion/compression requirements for the process of FIG. 7 is shown in the following Table VIII:

TABLE VIII

(FIG. 7)

STREAM FLOW PLAN SUMMARY - LB. MOLES/HR.

| STREAM | METHANE | ETHANE | PROPANE | BUTANE+ | TOTAL |
|---|---|---|---|---|---|
| 33 | 6181 | 208 | 71 | 123 | 6588 |
| 201 | 3819 | 84 | 14 | 6 | 3972 |
| 202 | 2362 | 124 | 57 | 117 | 2616 |
| 203 | 6177 | 25 | 3 | 1 | 6263 |
| 204 | 4 | 183 | 68 | 122 | 325 |

RECOVERIES

| | | |
|---|---|---|
| Ethane | 87.6% | 20,243 GAL/DAY |
| Propane | 95.8% | 8,982 GAL/DAY |

HORSEPOWER REQUIREMENTS

| | |
|---|---|
| Recompression | 3792 BHP |
| Refrigeration | 261 BHP |
| Total | 4053 BHP |

As can be seen by comparing the foregoing with Example 3, to achieve essentially the same recovery of ethane a great increase in horsepower is required. The increase in horsepower arises not only because of the unavailability of expansion work through expansion of a portion of the high-pressure vapor stream, but also because external refrigeration was required to achieve the temperature level needed to obtain the desired ethane recovery.

Figure 8:
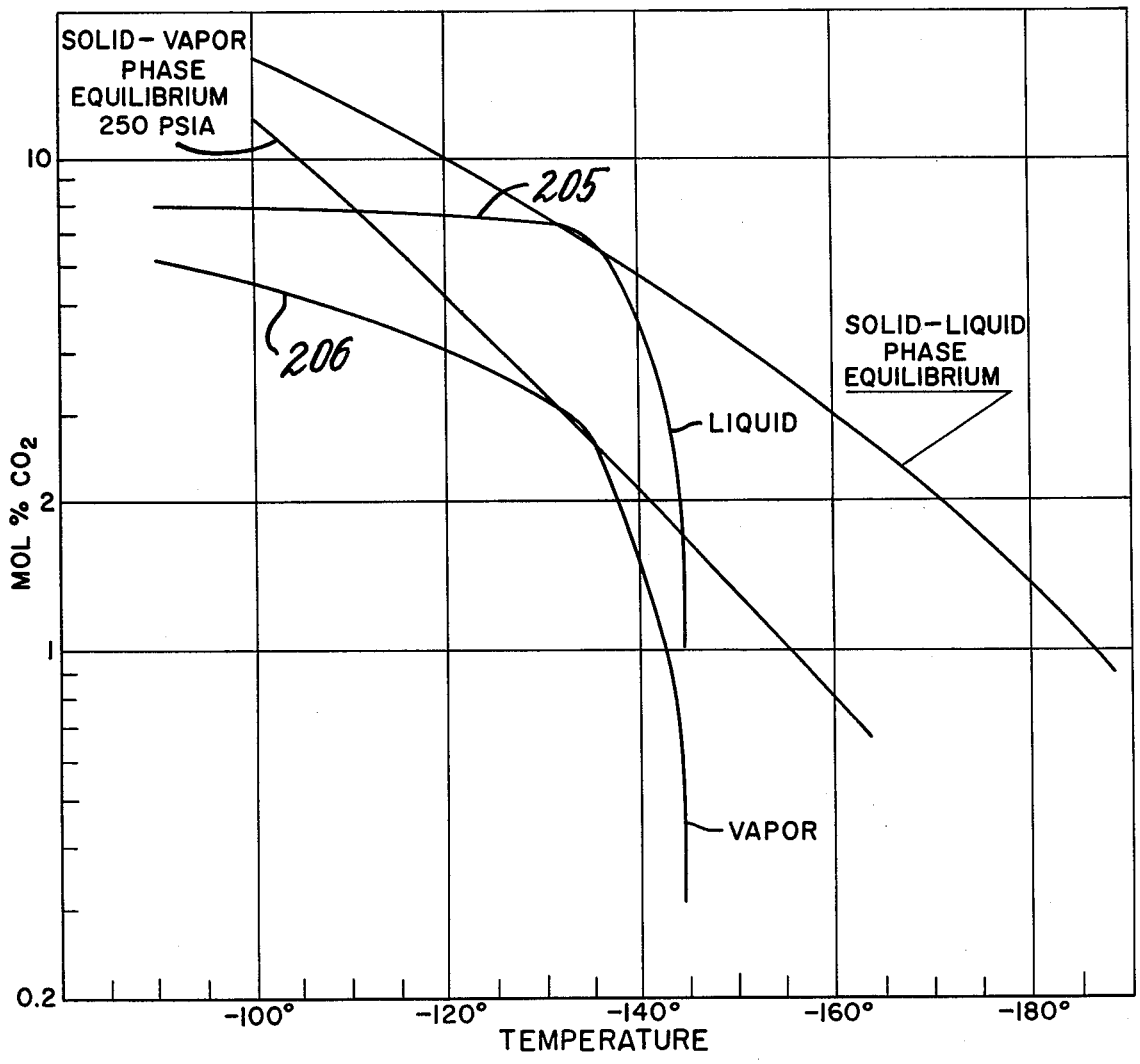
FIG. 8 is a carbon dioxide-temperature diagram comparing the processes of FIGS. 4 and 7.

It is also important to note that by expanding a portion of the high-pressure vapor and providing it as a mid-column feed, the carbon dioxide level in the column is reduced, and column icing conditions are thereby avoided. This is best seen by constructing carbon-dioxide-temperature diagrams in the same manner as FIGS. 6A and 6B were constructed. When following the process of the prior art, serious carbon dioxide icing problems are encountered in both liquid phase (line 205 of FIG. 8) and vapor phase (line 206 of FIG. 8). However, when the process of the present invention is used, the carbon dioxide icing is avoided, see FIG. 6B.

In the practice of the present invention, it will be recognized that the amount of vapor which is work expanded and supplied to the mid-column feed position will depend upon the amount of refrigeration which can be economically extracted from it balanced against the advantage of a reduced column overhead temperature which can be obtained by using that same gas to enrich the high-pressure liquid which is flash expanded to supply the top column feed. Selection of the amount of vapor work expanded and supplied to a mid-column feed position will also take into consideration the amount of vapor which must be supplied to the mid-column position in order to avoid carbon dioxide icing. As a general rule of thumb, we have found that for best results at least about 25% of the gas should be work expanded and supplied to the mid-column feed position and, for lean gases, about 50% or more of the gas should be work expanded.

We claim:

1. In a process for separation of a feed gas into a volatile residue gas and a relatively less volatile fraction, said feed gas containing hydrocarbons, methane and ethane together comprising a major portion of said feed gas, wherein (a) said feed gas under pressure is cooled sufficiently to partially condense said gas forming thereby a liquid portion of said feed gas and a vapor feed gas;

(b) at least some of the liquid portion is expanded in an expansion means to a lower pressure whereby a part of said liquid portion vaporizes to cool the expanded liquid portion to a refrigerated temperature; and (c) at least some of the expanded liquid portion is subsequently treated in a fractionation column to separate said relatively less volatile fraction;

the improvement comprising (1) combining at least part of liquid portion (a) with a process stream having a bubble point below the bubble point of said liquid portion (a), to form thereby a combined stream;

(2) supplying said combined stream to said expansion means at a temperature which is below the bubble point of said liquid portion (a);

(3) expanding said combined stream to said lower pressure, whereby the refrigerated temperature achieved in expansion step (b) is reduced;

(4) thereafter supplying at least some of said expanded combined stream to said fractionation column at a first feed position; and (5) expanding at least a portion of said vapor feed gas in a work expansion engine to said lower pressure, and supplying the expanded vapor to the fractionation column at a second feed point, said second feed point being at a lower column position than said first feed point.

2. The improvement according to claim 1 wherein at least 25% of the vapor feed gas is expanded to said lower pressure by work expansion.

3. The improvement according to claim 2 wherein the amount of feed gas vapor which is work expanded is sufficient to reduce the risk of carbon dioxide icing in the fractionation column.

4. The improvement according to claim 3 wherein said liquid portion (a) is cooled to a temperature below its bubble point prior to being combined with said process stream.

5. The improvement according to claim 4 wherein said process stream (1) is cooled prior to being combined with said liquid portion.

6. The improvement according to claim 3 wherein said combined stream is cooled prior to expansion.

7. The improvement according to claim 6 wherein said process stream (a) is cooled prior to being combined with said liquid portion.

8. In a process for separation of a feed gas into a volatile residue gas and a relatively less volatile fraction, said feed gas containing hydrocarbons, methane and ethane together comprising a major portion of said feed gas, wherein (a) said feed gas under pressure is cooled sufficiently to partially condense said gas, forming thereby a liquid portion of said feed gas and a vapor feed gas;

(b) at least some of said liquid portion is expanded in an expansion means to a lower pressure, whereby a part of said liquid portion vaporizes to cool the expanded liquid portion to a refrigerated temperature; and (c) at least some of the expanded liquid portion is subsequently treated in a fractionating column to separate said relatively less volatile fraction, the improvement comprising (1) dividing at least part of the liquid portion resulting in step (a) into a first stream and a remaining stream;

(2) expanding said first stream to said lower pressure, whereby a portion thereof vaporizes to cool the expanded first stream;

(3) directing said expanded first stream into heat exchange relation with the remaining part (1) of said liquid portion;

(4) combining said remaining part with a process stream having a bubble point below the bubble point of the liquid portion from step (a), thereby to form a combined stream;

(5) supplying said combined stream to an expansion means at a temperature which is below the bubble point of said liquid portion (a);

(6) expanding said combined stream to said lower pressure, whereby the refrigerated temperature achieved in said expansion is lower than the refrigerated temperature achieved in step (2);

(7) thereafter supplying at least some of said expanded combined stream to said fractionation column at a first feed position; and (8) expanding at least 25% of the vapor feed gas resulting from step (a) in a work-expansion engine, and supplying the expanded vapor to the fractionation column at a second feed point, and said second feed point being at a lower column position than said first feed point, the amount of said feed gas vapor which is work expanded being sufficient to reduce the risk of carbon dioxide icing in the fractionation column.

9. In a process for separation of a feed gas into a volatile residue gas and a relatively less volatile fraction, said feed gas containing hydrocarbons, methane and ethane together comprising the major portion of said feed gas, wherein (a) said gas under pressure is cooled sufficiently to partially condense said gas forming thereby a liquid portion of said feed gas and a vapor feed gas;

(b) the liquid portion at a temperature below its bubble point is expanded in an expansion means to a lower pressure whereby a part of said liquid portion vaporizes to cool the expanded liquid portion to a refrigerated temperature;

(c) at least some of said expanded liquid portion is subsequently treated in a fractionation columm to separate said relatively less volatile fraction;

the improvement comprising (1) combining a portion of said vapor feed gas and at least a part of the liquid portion (a) prior to expansion thereof to form thereby a combined stream;

(2) supplying said combined stream to said expansion means at a temperature below the bubble point of said liquid portion (a);

(3) expanding said combined stream to said lower pressure whereby the refrigerated temperature achieved in expansion step (b) is reduced;

(4) thereafter supplying at least some of said expanded combined stream to said fractionation column at a first feed point; and (5) expanding the remaining portion of the vapor feed gas in a word expansion and supplying the expanded remaining portion to said fractionation columm at a second feed point, said second feed point being at a lower column position than the first feed point.

10. The improvement according to claim 9 wherein at least 25% of said vapor feed gas is work-expanded to said lower pressure.

11. The improvement according to claim 10 wherein the amount of vapor feed gas work expanded to the lower pressure is sufficient to reduce the risk of carbon dioxide icing in the fractionation column.

12. A process according to claim 11 wherein at least part of the combined stream after expansion thereof is supplied to said fractionation column as the top column feed.

13. A process according to claim 11 wherein the combined stream is cooled prior to expansion by directing said stream into heat exchange contact with at least a part of the residue gas.

14. A process according to claim 13 wherein at least some of said vapor feed gas portion is cooled prior to combining it with said liquid portion.

15. A process according to claim 11 wherein at least a portion of said liquid portion is sub-cooled prior to combining it with said vapor feed gas portion.

16. A process according to claim 11, wherein said combined stream is cooled by directing said combined stream into heat exchange contact with the expanded remaining portion of the feed gas vapor before said expanded remaining portion is supplied to the fractionation column.

17. In an apparatus for the separation of a feed gas into a volatile residue gas and a relatively less volatile fraction, said feed containing hydrocarbons, methane and ethane comprising the major portion of said feed gas, said apparatus having (a) cooling means to cool said gas under pressure sufficiently to partially condense said gas and form thereby a liquid portion of said gas and a vapor feed gas;

(b) expansion means connected to said cooling means to receive said partly condensed feed gas and to expand it to a lower pressure, whereby it is further cooled; and (c) a fractionation column connected to receive at least a portion of the expanded feed gas from said expansion means (b), said distillation means being adapted to separate said relatively less volatile fraction, the improvement which comprises (i) means for combining at least part of the liquid portion obtained from said cooling means (a) with a process stream having a bubble point below the bubble point of said liquid portion (a) to form thereby a combined stream;

(ii) cooling means for cooling at least one of said part of said liquid portion, said process stream and said combined stream sufficiently that said combined stream has a temperature below the bubble point of said liquid portion (a);

(iii) means connecting said expansion means (b) to receive said combined stream at a temperature below the bubble point of said liquid portion (a), wherein said combined stream is expanded to said lower pressure;

(iv) means connecting said expansion means (b) to said fractionation column to supply at least a portion of the expanded combined stream as a feed to said fractionation column at a first feed point; and (v) work expansion means connected to said cooling means (a) to receive at least some of the vapor feed gas and to expand said lower pressure, said work expansion means being further connected to supply the expanded vapor feed gas to said fractionation column at a second feed point, said second feed point being at a lower column position than said first feed point.

18. The improvement according to claim 17 wherein the work expansion means (v) is adapted to expand at least 25% of the feed gas vapor.

19. The improvement according to claim 18 wherein the work expansion means (v) is adapted to expand a sufficient amount of feed gas vapor to reduce the risk of carbon dioxide icing in the fractionation column.

20. The improvement according to claim 19 wherein said cooling means (ii) comprises means to cool part of said liquid portion (a) to a temperature below its bubble point prior to combination of said liquid portion with said process

21. The improvement according to claim 20 wherein said cooling means further includes means for cooling said process stream prior to combination thereof with said liquid portion.

22. The improvement according to claim 19 wherein said cooling means (ii) comprises means for cooling said combined stream prior to expansion thereof.

23. The improvement according to claim 21 wherein said cooling means (ii) further includes means for cooling said process stream prior to combination thereof with said liquid portion.

24. An apparatus for the separation of a feed gas into a volatile residue gas and a relatively less volatile fraction, said feed gas containing hydrocarbons, methane and ethane together comprising the major portion of said feed gas, said apparatus having (a) cooling means to cool said gas under pressure sufficiently to partially condense said gas and form thereby a liquid portion of said gas and a vapor feed gas;

(b) expansion means connected to said cooling means to receive said partially condensed feed gas and to expand it to a lower pressure whereby it is further cooled; and (c) a fractionation column connected to receive at least a portion of the expanded feed gas from said expansion means (b), said fractionation column being adapted to separate said relatively less volatile fraction, the improvement which comprises (i) dividing means connected to receive at least part of said liquid portion (a), and to divide said part into a first stream and a remaining part;

(ii) expansion means connected to said dividing means to receive said first stream and to expand it to a lower pressure, whereby a portion thereof vaporizes to cool the expanded first stream;

(iii) heat exchange means connected to said expansion means to receive the remaining part of said liquid portion, said heat exchange means further being connected between said cooling means (a) and said dividing means (i) to direct the expanded first stream into heat exchange relation with said remaining part of said liquid portion;

(iv) means connected to said dividing means to receive said remaining part and to combine said remaining part with said process stream havung a bubble point below the bubble point of said liquid portion (a) to form said combined stream having (v) heat exchange means connected between said means (iv) and said expansion means (iii) adapted to further cool said combined stream prior to expansion thereof sufficiently that said combined stream has a temperature below the bubble point of said liquid portion (a);

(vi) means connecting said expansion means (b) to receive said combined stream at a temperature below the bubble point of said liquid portion (a), wherein said combined stream is expanded to said lower pressure;

(vii) means connecting said expansion means (b) to said fractionation column to supply at least a portion of the expanded combined stream as a feed to said fractionation column at a first feed point; and (viii) work expansion means connected to said cooling means (a) to receive at least 25% of the feed gas vapor and to expand it to said lower pressure, said work expansion means being further connected to supply the expanded vapor feed gas to said fractionation column at a second feed point, said second feed point being at a lower column position than the first feed point, said work expansion means further being adapted to expand a sufficient amount of feed gas vapor to reduce the risk of carbon dioxide icing in the fractionation column.

25. In an apparatus for the separation of a feed gas into a volatile residue gas and a relatively less volatile fraction, said feed gas containing hydrocarbons, methane and ethane, together comprising the major portion of said feed gas, said apparatus having (a) cooling means to cool said gas under pressure sufficiently to partially condense said feed gas and to form thereby a liquid portion of said feed gas and a vapor feed gas;

(b) expansion means connected to said cooling means to receive said liquid portion and expand it to a lower pressure, whereby a part of said liquid portion vaporizes to cool the expanded liquid portion; and (c) a fractionation column connected to receive at least some of said expanded liquid portion and to separate said relatively less volatile fraction, the improvement wherein said exchange means includes (i) means connected to said cooling means (a) for combining a portion of said vapor feed gas and at least part of said liquid portion prior to expansion thereof to form thereby a combined stream;

(ii) means for cooling at least one of said liquid portion, said vapor feed gas and said combined stream sufficiently that said combined stream has a temperature below the bubble point of said liquid portion (a) prior to expansion thereof;

(iii) means connecting said expansion means (b) to receive said combined stream at a temperature below the bubble point of said liquid portion (a), wherein said combined stream is expanded to said lower pressure;

(iv) means connecting said expansion means (b) to said fractionation column to supply at least a portion of the expanded combined stream to the fractionation column at a first feed point; and (v) work expansion means connected to said cooling means (a) to receive the remaining portion of the vapor feed gas and to expand it to said lower pressure, said work expansion means being further connected to supply the expanded remaining part to the fractionation column at a second feed point, said second feed point being at a lower column position than the first feed point.

26. The improvement according to claim 25 wherein said work expansion means is adapted to expand at least 25% of the vapor feed gas to said lower pressure.

27. The improvement according to claim 26 wherein the work expansion means is adapted to expand a sufficient amount of said vapor feed gas to said lower pressure to reduce the risk of carbon dioxide icing in said column.

28. In the improvement according to claim 27, the further improvement including means connected to supply said combined stream after expansion thereof to said fractionation column as the top column feed.

29. In the improvement according to claim 27, the further improvement wherein said cooling means (ii) includes means for cooling said combined stream prior to expansion thereof connected to direct said combined stream to heat exchange contact with at least part of residue gas produced by said apparatus.

30. In the improvement according to claim 29, the further improvement wherein said cooling means (ii) includes means for cooling said vapor feed gas portion prior to combining it with said liquid portion.

31. In the improvement according to claim 27, the further improvement wherein said cooling means (ii) includes means for cooling said liquid portion prior to combination of it with said vapor feed gas portion.

32. In the improvement according to claim 27, the further improvement including (1) dividing means connected to said cooling means (a) to receive said vapor feed gas and to divide it into a first part and a second part;

(2) means connecting said dividing means (1) to said combining means (i), whereby said first part of said vapor feed gas is combined with at least a portion of said liquid portion (a) prior thereof to form said combined stream;

(3) expansion means connected to said dividing means (1) to receive said second part of said vapor feed gas and to expand said second part to said lower pressure to produce thereby a cooled vapor stream; and (4) heat exchange means connected to receive said cooled vapor stream and further being connected between said combining means (i) and said expansion means (iii) to direct said cooled vapor stream into heat exchange contact with said combined stream, thereby to cool said combined stream.

* * * * *

UNITED STATES PATENT OFFICE

CERTIFICATE OF CORRECTION

Patent No. 4,157,904 Dated June 12, 1979

Inventor(s) Roy E. Campbell et al.

It is certified that error appears in the above-identified patent and that said Letters Patent are hereby corrected as shown below:

Col. 9, line 7, "stream is" should read --stream at--;
Col. 11, line 58, "-133°F." should read --about -133°F.--;
Col. 13, line 44, "ca be" should read --can be--;
Col. 14, line 39, "60.55%" should read --60.92%--;
Col. 18, line 11, "(a)" should read --(1)--;
Col. 19, line 26, "word" should read --work--;
Col. 20, line 48, after "process", insert --stream.--;
Col. 20, line 56, "claim 21" should read --claim 22--; and
Col. 21, line 27, "havung" should read --having--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*